US006617945B2

(12) United States Patent
Lotz et al.

(10) Patent No.: US 6,617,945 B2
(45) Date of Patent: Sep. 9, 2003

(54) FILTER WITH AN ELECTRICALLY TUNABLE RESONATOR

(75) Inventors: Frederic Roger Lotz, Le Taillan Medoc (FR); Pierre Jean Monteil, Pyla Sur Mer (FR); Patrick Albert Georges Desrumaux, Paris (FR); Gerard Ernest Emile Forterre, Colombes (FR)

(73) Assignee: Tekelec Temex, Sevres (FR)

( * ) Notice: Subject to any disclaimer, the term of this patent is extended or adjusted under 35 U.S.C. 154(b) by 0 days.

(21) Appl. No.: 09/801,857

(22) Filed: Mar. 9, 2001

(65) Prior Publication Data

US 2002/0180564 A1 Dec. 5, 2002

(30) Foreign Application Priority Data

Mar. 9, 2000 (FR) ..... 0003044

(51) Int. Cl.[7] ..... H01P 7/04
(52) U.S. Cl. ..... 333/231; 333/223; 333/101
(58) Field of Search ..... 333/231, 223, 333/207, 205, 209, 174, 17.1, 202, 101

(56) References Cited

U.S. PATENT DOCUMENTS 4,588,967 A 5/1986 Horn et al.
5,260,658 A * 11/1993 Greim et al. ..... 324/322
5,495,215 A * 2/1996 Newell et al. ..... 333/202
6,133,810 A * 10/2000 Shockley ..... 333/207

FOREIGN PATENT DOCUMENTS

DE 1 266 374 A 4/1968
EP 1132996 A1 * 9/2001 ..... H01P/7/04
JP 10098313 A 4/1998

OTHER PUBLICATIONS

River et al., "Lumped Parameters Of A Reentering Cylindrical Cavity", IEEE Transactions on Microwave Theory and Techniques, vol. MTT–19, No. 3, Mar. 1971.

* cited by examiner

*Primary Examiner*—Robert Pascal
*Assistant Examiner*—Dean Takaoka
(74) *Attorney, Agent, or Firm*—Leydig, Voit & Mayer, Ltd.

(57) ABSTRACT

A filter or multicoupler has at least one resonator which can be electronically tuned by a tuning device, has at least one tuning element such as a tuning capacitor, a switching element for selectively connecting the tuning element electronically to the resonator, and a control device for the switching element. The resonator is a coaxial quarter-wave resonator with a central component having free surface perpendicular to the central axis for mounting of tuning devices.

15 Claims, 4 Drawing Sheets

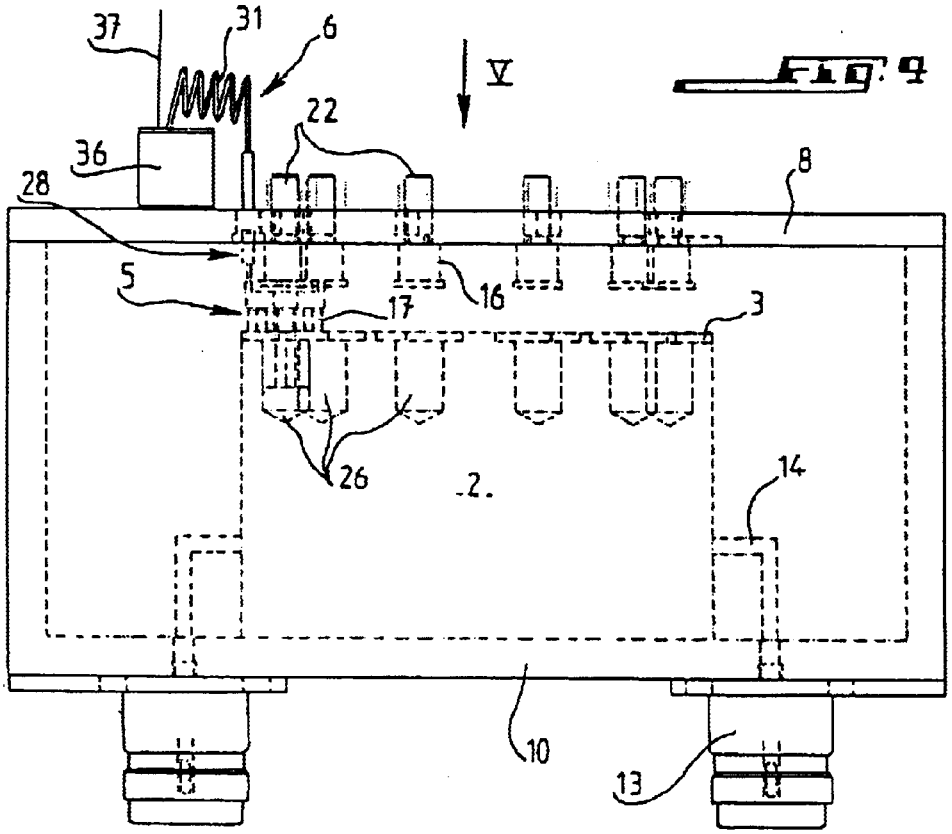
Fig. 4
Fig. 5
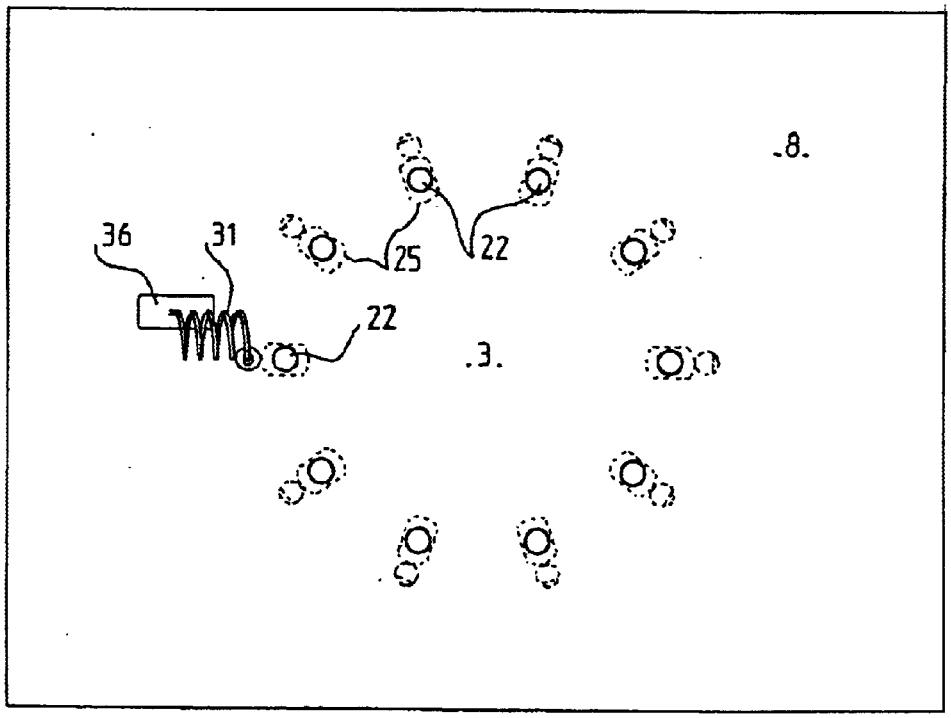

FILTER WITH AN ELECTRICALLY TUNABLE RESONATOR

FIELD OF THE INVENTION

The invention relates to a filter or multicoupler which includes a resonator that can be electronically tuned by a tuning device and which has at least one tuning element, a switching element for selectively connecting the tuning element electrically to said resonator, and a control device for the switching element.

BACKGROUND

Some filters and multicouplers are already known. However, the known devices have proven unable to bring about simultaneously broad frequency tuning bands, high power functioning, very short electronic tuning time, and reduced insertion losses. The mounting between the different elements constituting a tuning device requires the soldering of contact wires, and their assembly is problematic, particularly because of the mechanical tolerances and thermal expansion between the different elements. These problems grow with an increase in the tuning frequency band and the number of tuning elements necessary for this purpose.

SUMMARY OF THE INVENTION

The present invention aims to propose an arrangement which palliates the disadvantages just stated.

In order to attain this goal, a tunable arrangement according to the invention has a coaxial resonator, of the quarter-wave type, with a central component constituting a line having a cylindrical shape with an upper surface for mounting of the tuning devices.

According to one aspect of the invention, the different elements constituting a tuning device which dissipate energy and have different thermal drain are mounted in a removable manner.

According to another aspect of the invention, the aforementioned elements are maintained in mechanical and electrical contact in the tuning device under the effect of pressure forces, advantageously a spring.

According to another aspect of the invention, a PIN diode and a tuning capacitor are mounted in series between an upper plate of the resonator and the body forming the line, the diode being attached in a removable manner by its casing to the upper plate and the tuning capacitor being attached in a removable manner to the body, and the two being electrically interconnected in series by a spring washer.

According to yet another aspect, the casing of the PIN diode has a threaded end piece intended for passing through the upper ground plate and is provided with a shoulder for resting against the internal surface of the plate under the squeezing effect of a nut screwed on the end piece on the other side of the plate.

According to yet another aspect of the invention, the tuning capacitor has a support provided with a threaded end piece which can be screwed into the upper surface of the body forming the line.

According to yet another aspect of the invention, the PIN diode rests on a frontal surface of a spring washer in contact with a support resting on the tuning capacitor.

According to yet another aspect of the invention, the tuning capacitor has a number of power capacitors connected in parallel and soldered in the aforementioned threaded support.

According to yet another aspect of the invention, the electrical contact between the control device for a PIN diode and the controlled PIN diode is formed by a contact element including a spring pin of which one end is connected to a choke coil of the control circuit while the other end is pressed under the effect of a spring against the aforementioned washer support.

According to yet another aspect of the invention, the upper surface for mounting of the tuning devices is suitable for mounting of a larger number of tuning devices than that which is strictly necessary for the production of the frequency increments, so as to increase the number of tuning increments, the maximum power or both.

BRIEF DESCRIPTION OF THE DRAWINGS

The invention will be better understood, and other characteristics, details and advantages of it will appear more clearly in the following explanatory description in reference to the appended diagrammatic drawings given only as an example, illustrating an embodiment of the invention and in which:

FIG. 4 is a view similar to FIG. 1 of a coaxial cavity resonator according to the invention, provided with a number of tuning devices, FIG. 5 is a top view in the direction of arrow V of FIG. 4.

The figures show, as an example of implementation of the invention, a multicoupler which can be tuned in a frequency band of one octave, electronically, with a short switching time, with power for the domain of high frequencies, up to ultra high frequencies and microwaves, with a low degree of intermodulation.

Figure 1:
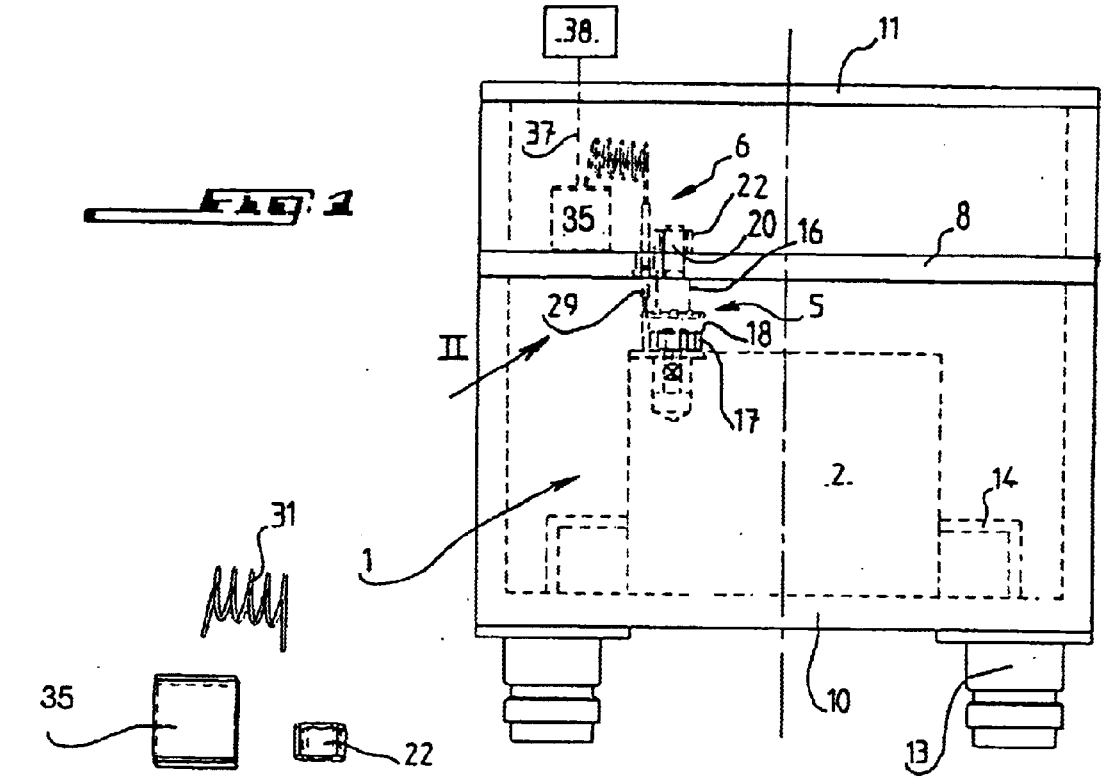
FIG. 1 is a diagrammatic side view of a coaxial cavity resonator according to the invention.

This multicoupler essentially has a coaxial cavity resonator 1, with low impedance, of the quarter-wave type, whose central body 2 constituting the line has a cylindrical shape and an upper surface 3 for mounting of a number of tuning devices 5, only one of which is shown in FIG. 1. This device 5 is controlled by a control device 6 arranged partly on an upper plate 8 of the resonator, rectangular in shape, and partly at the exterior. This plate is grounded. Reference numbers 10 and 11 respectively designate structural sections forming the exterior walls of the resonator and the cap of the zone of the polarization circuits. Reference numbers 13 and 14 respectively indicate the connectors and the coupling loops for access connectors 13.

Figure 2:
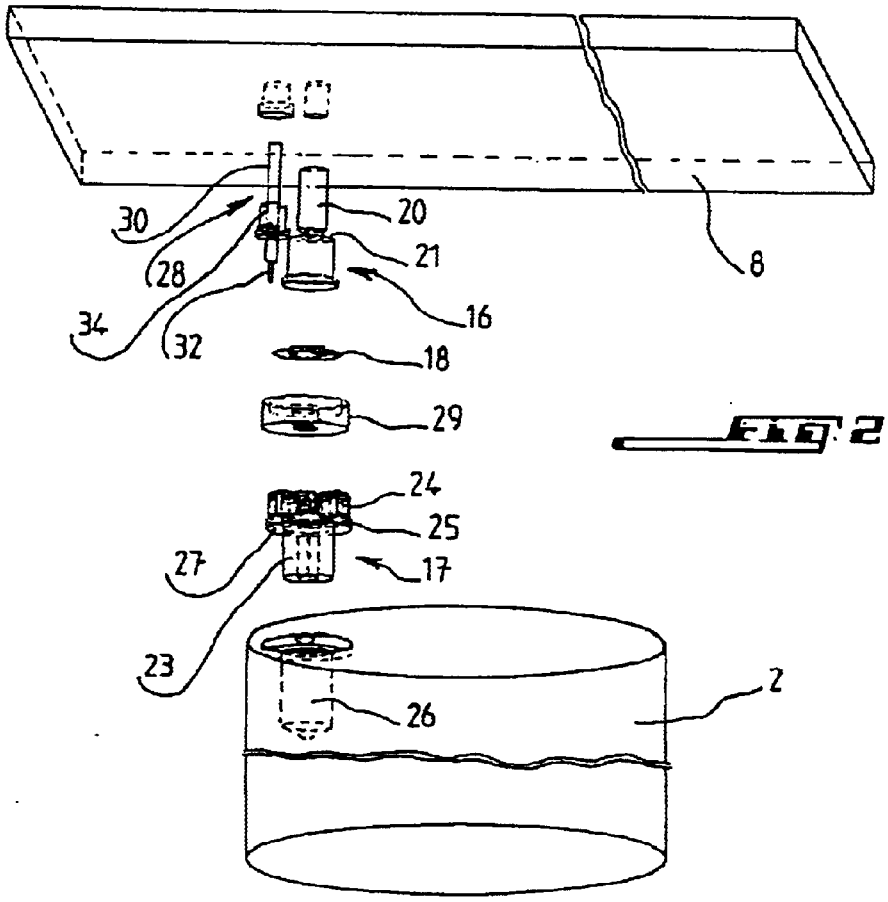
FIG. 2 is an exploded view of the part indicated by arrow II in FIG. 1.
Figure 3:
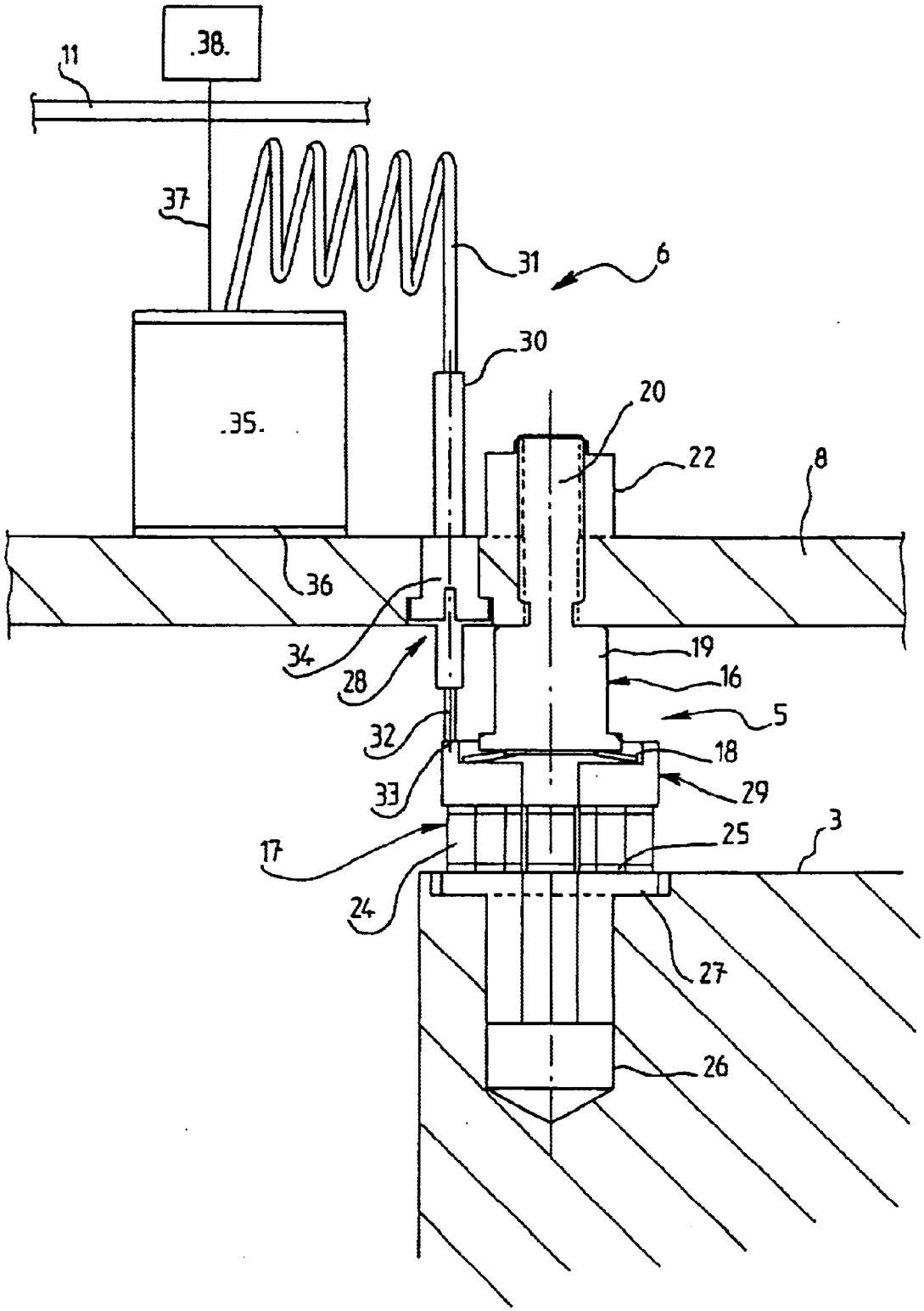
FIG. 3 is a view on a larger scale and in perspective of part II of FIG. 1.

In reference in particular to FIGS. 2 and 3, the structure and mounting of tuning device 5 according to the invention will be described hereafter. Such a device essentially has a high power PIN diode 16 attached under upper plate 8 and a tuning capacitor 17 mounted on upper surface 3 of body 2, these two elements being mounted in series through a spring washer 18.

More precisely, a casing 19 of PIN diode 16 is provided with a threaded end piece 20 which passes through plate 8 and has a shoulder 21 which is pressed against the lower surface of the plate 8 by an adjusting nut 22 screwed onto the free end of an end piece 20.

The tuning capacitor 17 is a thick power capacitor, with reduced losses, consisting of a number of ceramic microwave-type capacitors 24 connected in parallel and soldered onto a shared support 25 from which projects an end piece 23 which can be screwed into an opening 26 in the upper surface 3 of the central body 2 of the resonator. The support 25 and the end piece 23 form a shoulder 27 by which the support 25 is supported on the upper surface 3 of the body 2. Constituting the tuning capacitor in such a way maintains the Q of each capacitor element and, therefore, supports elevated power without deterioration of the performance of the tunable filter.

A washer 18 is received in a cylindrical washer support 29 which rests on the upper surface of the capacitors 24. The upper surface of the washer 18 is in electrical contact with the PIN diode 16.

The tuning device 5 is connected electrically to the control device 6 for the diode by an electrical contact in the form of a spring pin 28, which passes through the plate 8, engaging an insulating sleeve 34 and of which one end is connected to a choke coil 30 while another end 32 is pressed by a spring (not represented) against an annular surface 33 of the washer support 29, which surrounds the housing of washer 18.

It should also be noted that choke coil 31 is connected to capacitor 35, grounded on plate 8 at 36 and connected by a conductor 37 to an exterior part 38 of the control device.

In reference to FIGS. 4 and 5, one observes that the multicoupler arrangement according to the invention has a number of tuning devices 5, mounted on circular upper surface 3 of the unit forming line 2 of the coaxial resonator. These tuning devices are arranged in an angularly equidistant manner in a circle near the periphery of body 2. The use of a coaxial cavity makes it possible to have a relatively large surface for mounting of the tuning devices. The number of these devices 5, defined by the desired tuning band, the desired frequency increment, and the behavior in terms of power, can thus be greater than necessary. The invention thus makes it possible to reduce the voltages at the terminals of the PIN diodes. In the example represented, ten diodes are provided, while, for example, only eight are necessary.

It should be noted that the relative positions of the tuning devices are not just any positions. In order to obtain the best performance, it is advantageous to arrange the capacitors in such a way that the difference between two successive tuning capacitors is as small as possible.

As an example, one will choose the arrangement of the ten capacitors noted a to j in FIG. 5 in the manner indicated in the following table, the first column indicating the capacitor, the second column the capacitance in pF and the third column the binary number represented by the capacitor. This table shows, as indicated above, that the last two capacitors constitute the ninth binary number, which makes it possible to improve the behavior in terms of power of the last tuning increment.

| Tuning Capacitor | Capacitance (pF) | Binary Number |
|---|---|---|
| a | 0.1 | 1 |
| b | 0.2 | 01 |
| c | 0.4 | 001 |
| d | 0.8 | 0001 |
| e | 1.6 | 00001 |

-continued

| Tuning Capacitor | Capacitance (pF) | Binary Number |
|---|---|---|
| f | 3.2 | 000001 |
| g | 6.4 | 0000001 |
| h | 12.8 | 00000001 |
| i | 12.8 | 000000001 |
| j | 12.8 | 0000000001 |

Figure 6:
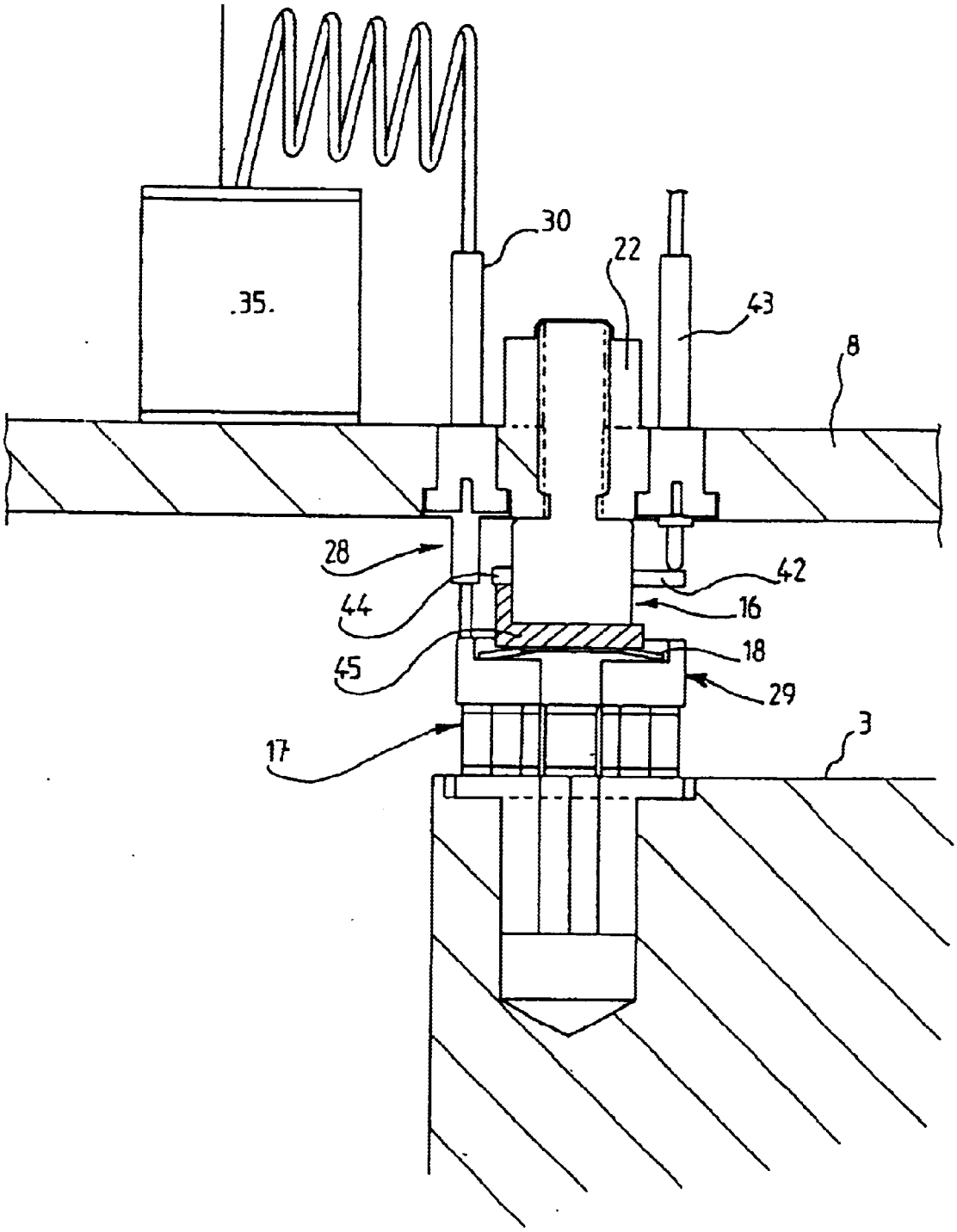
FIG. 6 is a view similar to FIG. 3, but with the switching element including a transistor.

Of course, many modifications can be made on the embodiment of the invention just described. In the example given, the switching elements are PIN diodes. However, other semiconducting switching elements can be chosen. Thus, the switching element can consist of a transistor. FIG. 6 shows the mounting of such a transistor. In this figure, the same references as in FIGS. 1 to 5 are used for identical or similar components. The switching element 16, which is now a transistor, has three ohmic contacts which are connected to voltage sources. The terminal dissipating the most energy, namely, the collector or drain, is grounded, for example, by screwing it or its support to the plate 8, in the manner of end piece 20. Polarization electrode 42, namely, the base or the gate, is polarized directly by contact element 43 of the same type as contact 28. The third electrode, namely, the emitter or source 44, which comes out laterally from the casing of the transistor, is connected by an additional element 45 to support 29 of the tuning capacitor. It will then be polarized as described for the PIN diode.

The choice between a transistor and a PIN diode could be made from manufacturing parameters and performance desired for the filter. With regard to the dimensions of the transistor, they do not constitute a problem since it is possible to adapt as a consequence the diameter of the coaxial core.

The invention as described and represented in the figures achieves numerous advantages. By puffing tuning capacitors with improved overvoltage in series with the high power PIN diodes, a solution is supplied to the main problem of use of these diodes which lies in their excessively high loss coefficient or their excessively low overvoltage as well as in their high stray capacitance due to the casing and which limits the variation of frequency which can be brought about by a single PIN diode. The use of a coaxial cavity gives one a greater upper surface allowing the mounting of a greater number of tuning elements than the number which is strictly necessary. The invention proposes the use of thick power capacitors, with reduced losses, consisting, for example, of six ceramic microwave-type capacitors, connected in parallel and soldered to a shared screwable support. The mounting of the tuning devices, with a spring contact and a spring washer, ensures separation of the energy-dissipating elements, each having a different thermal drain. The invention thus allows easy mounting, which tolerates variations of dimensions due to mechanical tolerances and thermal expansions, and possible diode-to-diode maintenance. There is no longer any soldering of contact wires on the diodes. The maintaining of the initial reliability of the diodes is thus ensured. The mounting according to the invention of the different elements constituting the tuning devices between one another and on the upper plate and the central unit of the resonator allows easy maintenance and removal of the tuning devices and replacement of the diodes. Furthermore, the thermal contacts between the casings of the PIN diodes and the ground plate and between the tuning capacitors and the central unit are excellent. It should furthermore be noted that the invention can be used preferably in a band of frequencies ranging from tens of MHz to several GHz.

What is claimed is:

1. A filter including;

an electronically tunable resonator, at least one tuning capacitor, a switching element for selectively connecting the tuning capacitor to the resonator, a control device for the switching element, wherein the resonator is a quarter-wave coaxial resonator with a central component having a free surface, perpendicular to a central axis of the coaxial resonator, for mounting of the tuning capacitor, and a plurality of tuning devices having different thermal dissipations removably mounted on the free surface.

2. The filter according to claim 1 including a spring in mechanical and electrical contact with the tuning device.

3. The filter according to claim 2 wherein the switching element and the tuning capacitor are mounted in series between an upper plate of the resonator and a body, the switching element being removably attached to the upper plate and the tuning capacitor being removably attached to the body, and including a spring washer electrically interconnecting the switching element and the tuning capacitor.

4. The filter according to claim 3 including a spring washer resting on one surface of the switching element and having a surface received in a support resting on the tuning capacitor.

5. The filter according to claim 4, including a spring pin providing electrical contact between the control device for the switching element and the control element, the spring pin having a first end connected to the control device and a second end pressed against the support.

6. The filter according to claim 3, wherein the tuning capacitor has a support with a threaded end piece.

7. The filter according to claim 6, wherein the tuning capacitor includes a plurality of power capacitors connected in parallel and soldered into the support.

8. The filter according to claim 7, wherein the power capacitors are arranged in a ring.

9. The filter according to claim 8, wherein the capacitors are arranged so that capacitance differences between successive power capacitors is minimized.

10. The filter according to claim 3, wherein the switching element has a threaded end piece passing through the upper plate and having a shoulder resting against the upper plate and including a nut screwed onto the end piece with the plate between the shoulder and the nut.

11. A filter including:

an electronically tunable resonator, at least one tuning capacitor, a PIN diode switching element for selectively connecting the tuning capacitor to the resonator, and a control device for the PIN diode switching element, wherein the resonator is a quarter-wave coaxial resonator with a central component having a free surface, perpendicular to a central axis of the coaxial resonator, for mounting of the tuning capacitor.

12. The filter according to claim 11, including a plurality of tuning devices having different thermal dissipations removably mounted on the free surface.

13. A filter including:

an electronically tunable resonator, at least one tuning capacitor, a transistor switching element for selectively connecting the tuning capacitor to the resonator, and a control device for the transistor switching element, wherein the resonator is a quarter-wave coaxial resonator with a central component having a free surface, perpendicular to a central axis of the coaxial resonator, for mounting of the tuning capacitor.

14. The filter according to claim 13, including a plurality of tuning devices having different thermal dissipations removably mounted on the free surface.

15. The filter according to claim 13, wherein the transistor has a collector or drain that is grounded, a base or a gate, and an emitter or a source in contact with a support of the tuning capacitor.

* * * * *